US006423955B1

(12) United States Patent
Blaker et al.

(10) Patent No.: US 6,423,955 B1
(45) Date of Patent: Jul. 23, 2002

(54) HIGH FREQUENCY DIELECTRIC HEATING SYSTEM

(75) Inventors: Glenn Craig Blaker, North Vancouver; Terry Albert Enegren; Yiu Kwan (Eugene) Ho, both of Vancouver; Scott Ronald Spencer, Nelson, all of (CA)

(73) Assignee: Heatwave Technologies Inc., Crescent Valley (CA)

( * ) Notice: Subject to any disclaimer, the term of this patent is extended or adjusted under 35 U.S.C. 154(b) by 0 days.

(21) Appl. No.: 09/903,659

(22) Filed: Jul. 13, 2001

(51) Int. Cl.[7] ..... H05B 6/54

(52) U.S. Cl. ..... 219/775; 219/772; 219/778; 219/780; 34/254; 34/255

(58) Field of Search ..... 219/772, 778, 219/780, 775, 776; 34/250, 254, 255

(56) References Cited

U.S. PATENT DOCUMENTS

| | | | | |
|---|---|---|---|---|
| 1,960,173 | A * | 5/1934 | Smith | |
| 3,986,268 | A | 10/1976 | Koppelman | 34/250 |
| 4,472,618 | A | 9/1984 | Cloer | 219/780 |
| 6,080,978 | A | 6/2000 | Blaker | 219/775 |
| 2002/0003141 | A1 * | 1/2002 | Blaker et al. | 219/778 |

* cited by examiner

*Primary Examiner*—Philip H. Leung
(74) *Attorney, Agent, or Firm*—C. A. Rowley

(57) ABSTRACT

A method and apparatus for dielectric drying is disclosed wherein a load to be heated positioned on a carrier the bottom of which provides a secondary electrode is moved with the carrier a dielectric heating chamber having a primary electrode positioned above load when said load on said carrier is moved into an operative position in the chamber. The carrier and load are elevated into heating position and this movement simultaneously connects the secondary electrode to ground, so that when high frequency power is applied to the primary electrode the circuit is made to dielectrically heat the load.

21 Claims, 6 Drawing Sheets

FIG. 2
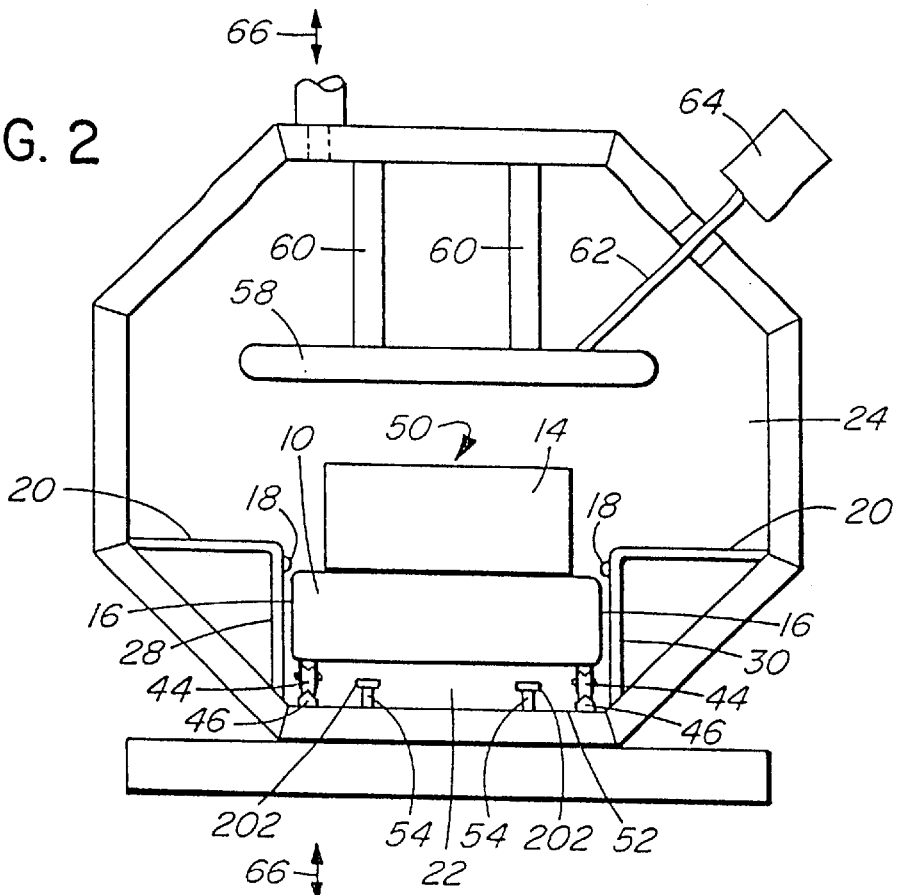
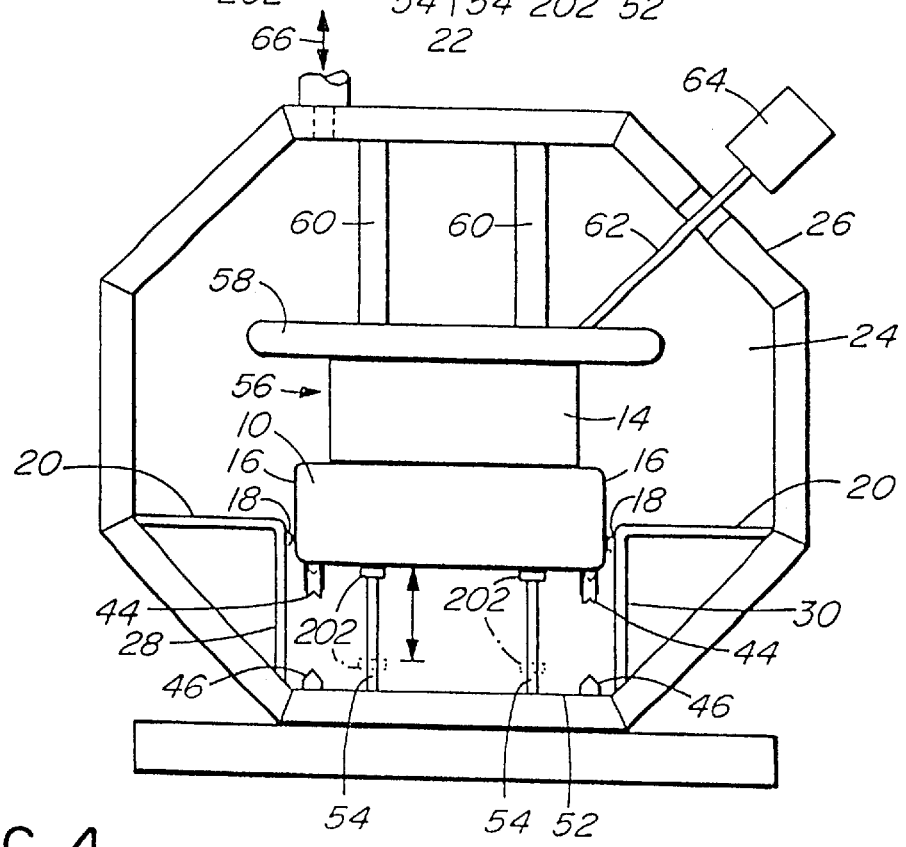
FIG. 4

HIGH FREQUENCY DIELECTRIC HEATING SYSTEM

FIELD OF INVENTION

The present invention relates to an improved dielectric heating system having a simplified contact system to automatically connect the bottom electrode to ground.

BACKGROUND OF THE INVENTION

Uses of dielectric heating/drying systems are known and are currently in use or have been proposed for use in agriculture, polymer manufacture, pharmaceuticals, bulk powder, food processing, wood products, panel manufacture, and other industries. One of the key industries using these dielectric heating/drying systems is the wood products industry and the present invention will be described particularly with respect to the wood products industry, although the invention, with suitable modifications where required, may be applied in the other industries in which dielectric heating/drying is to be performed.

In dielectric drying or heating systems particularly those used for drying wood, it is the conventional practice to load the material to be dried onto a wheeled cart and to roll the loaded cart into the kiln which is provided with rails to receive the wheels of the cart. See for example, U.S. Pat. No. 3,986,268 issued Oct. 19, 1976 to Koppelman and U.S. Pat. No. 4,472,618 issued Sep. 18, 1984 to Cloer. In these systems, the carts serve as both a conveyor and electrode. Clearly the cart, which is the electrode, is moveable and thus the cart-electrode must be moved into the kiln and connected electrically before the kiln chamber is closed and the drying process proceeds.

As above indicated, all of these cart systems require manually connecting the grounding system to the cart loaded with material to be dried and positioned in the kiln before the drying cycle may be started and disconnecting the grounding system after drying and before the loaded cart may be moved from the kiln. This loading and unloading, connecting and disconnecting etc., necessitates the use of professionally trained personnel both for safety and operating procedures to better ensure there are no major problems or accidents. These limitations imposed primarily by the use of carts have given the process of dielectric drying a reputation as being non-robust in that it requires flimsy attachments, which lead those in the lumber industry to imply that the technique is still in the research or experimental stage, and has not yet been developed for commercial industrial purposes.

U.S. Pat. No. 3,986,268 issued Oct. 19, 1976 to Koppelman recognized the problem of carts and in one embodiment employs vertical electrodes and uses a conveyor (roller conveyor) to deliver the load to be dried into position between the vertical electrodes and then after drying to convey the dried load from between the electrodes. This system could permit computer-controlled operation, however it was found that uniform contact of the vertical electrodes with the sides of the load was difficult and could not be consistently made whereby the effectiveness of the system was compromised.

U.S. Pat. No. 6,080,978 issued Jun. 27, 2000 teaches the use of a conveyor system with the conveyor portion within the kiln directly connected to ground to provide a continuous system where attachment of grounding straps to a cart is eliminated entirely. This system is more suited to applications requiring both an infeed and outfeed door where the load does not need to be reversed.

BRIEF DESCRIPTION OF THE PRESENT INVENTION

It is the main object of this invention to provide a cart conveying system for a dielectric drying system wherein the grounding of the cart is automatically accomplished by movement of the cart to operative position.

Broadly the present invention relates to a method and apparatus for dielectric drying of a load comprising positioning the load on a carrier incorporating a secondary electrode, moving the load on said carrier substantially horizontally into a chamber having a primary electrode positioned above said load when said load on said carrier is moved into an operative position in the chamber, elevating said carrier and said load to vertically move said load into heating position while simultaneously connecting said carrier and thereby said secondary electrode to ground, applying high frequency power to said primary electrode to dielectrically heat said load.

Preferably said high frequency is radio frequency (RF).

Preferably said elevating moves said load into intimate contact with said primary electrode.

Preferably after said heating is completed, said carrier and said load are lowered to said operative position and then said carrier and said load are removed from said chamber.

Preferably during drying, said load is separated from said primary electrode and weighed.

Broadly, the present invention relates to an apparatus for dielectric heating of a load comprising a carrier, means forming a secondary electrode on said carrier, a first set of electrical contacts along the outer periphery of said carrier and connected to said secondary electrode, a heating chamber, means defining a pathway for said carrier into said chamber, a primary electrode in said chamber positioned above said pathway, elevating means positioned along said pathway so that said carrier when positioned in operative position in said pathway may be lifted by said elevating means into heating position, a cooperating set of electrical contacts secured along said pathway, contacts of said set of cooperating contacts being in position to make electrical contact with adjacent contacts of said first set of contacts on said carrier and form mating connections between contacts of said first set of contacts and said cooperating set of contacts when said elevating means has raised said carrier to said heating position from said operative position, and means connecting said primary electrode to a source of high frequency power.

Preferably said mating connections are formed by a flexible contact and a plate contact.

Preferably said flexible contact is one of said set of cooperating contacts.

Preferably the chamber is provided with at least one door, and further electrical contact means are provided on said door, means to move said door to a closed position and to a sealing position wherein said door is sealed and said further electrical contact means are positioned to make electrical contact with an adjacent contact of said first set of electrical contacts when the carrier and load are elevated from operative position to heating position.

Preferably said flexible electrical contacts are made from fingerstock having fingers extending from a connecting band and formed into an open triangular cross section with a pair of spaced bearing areas forming one incomplete side of said triangular cross section, said connecting band forming one of said pair of bearing areas and free ends of said fingers remote from said connecting band forming the other of said pair of bearing areas.

Preferably said bearing area formed by the band is fixed to its supporting structure and the bearing area formed by the free end bears against but is free to move relative to the supporting structure.

Preferably contacts of said set of cooperating electrical contacts are provided on all sides and end of said pathway and cooperate with adjacent contacts of the first set of electrical contacts.

Preferably said carrier is formed by a plurality of carts in end to end relationship and with mating connection being formed between adjacent ends of adjacent of said carts.

BRIEF DESCRIPTION OF THE SEVERAL VIEWS OF THE DRAWING(S)

Further features, objects and advantages will be evident from the following detailed description of the preferred embodiments of the present invention taken in conjunction with the accompanying drawings in which;

FIG. 2 is a section across the chamber or kiln illustrating the inside of the kiln and the position of the cart and load as it enters the kiln and is moved horizontally to operative position.

FIG. 4 is a section similar to FIG. 2 but showing the cart and load in elevated heating position.

DETAILED DESCRIPTION OF THE INVENTION

Figure 1:
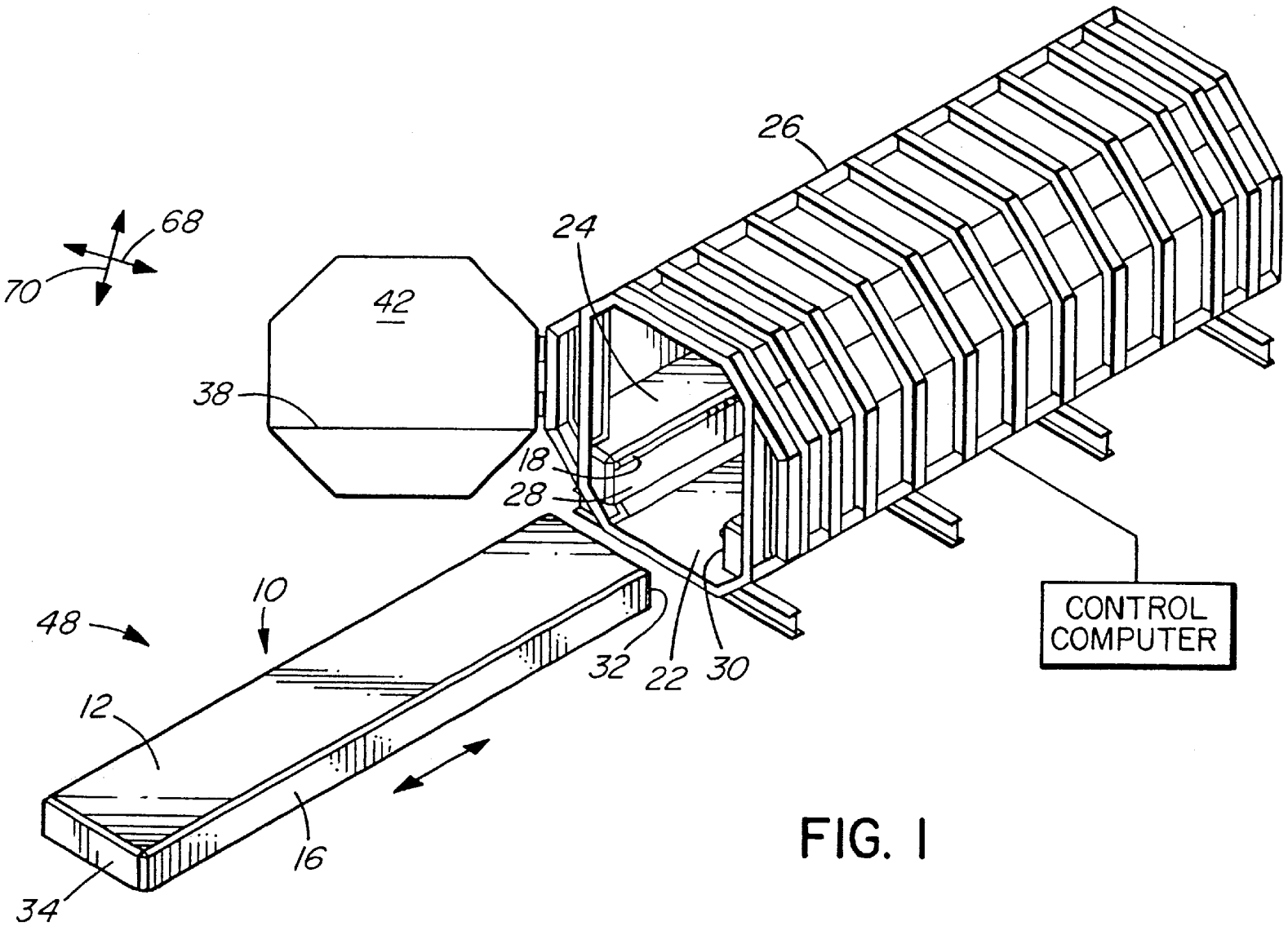
FIG. 1 is an isometric illustration of the present invention applied to a heating chamber in the form of a vacuum kiln for drying wood and showing a carrier or cart in position to enter the kiln.

As shown in FIG. 1 a carrier in the form of a cart 10 is provided. The carrier 10 has an upper deck 12 that functions to support the load 14 (see FIG. 2) and as a secondary electrode for applying power to the load 14 during the dielectric heating process as will be described below. A first set of electrical contacts is provided around the periphery of the carrier or cart 10 and generally includes a pair of contacts 16 one at each side of the carrier 10 each extending the full length of the carrier 10 and a pair of end contacts 32 and 34 for making electrical contact with an adjacent electrical contact of a set of cooperating contacts which includes the contacts 18 (see FIGS. 1 and 3) mounted in fixed relationship to a connection table 20 which defines a path 22 along which the carrier 10 and load are moved into and out of the heating chamber 24 of the heater or dryer or kiln 26 and 36 and 38 at the end and on the door of the chamber 24. The contacts of the set of cooperating contacts 18 are fixed to the side or peripheral walls 28 and 30 of the passage or path 22 in a manner to be described below and are positioned along the upper portion of the path 22 facing in and projecting toward the center of the path 22.

Adjacent pairs of contacts, one contact from the first set of electrical contacts (16, 32 and 34 and the other from the cooperating set of contacts 18, 36 and 38 making mating electrical contact are formed by one flexible contact and one plate like contact. In the illustrated arrangement, contacts of the cooperating set of contacts 18, 36 and 38 (fixed to the kiln 26 are shown as flexible and contacts of the first set of contacts 16, 32 and 34 (on the cart 10) have been shown as plate like contacts, but some or all may be reversed if desired.

The carrier or cart 10, as above indicated, is provided with a pair of end contact plates 32 and 34 each of which extends across the full width of the cart 10 at the front and back respectively of the cart or carrier 10 respectively. These contact plates 32 and 34 are positioned to cooperate with (make mating electrical contact with) the flexible contacts 36 and 38 respectively as will be described below. The contact 36 is fixed to the end wall 40 of the path 22 (also the end wall of the kiln 26 in the illustrated arrangement and the contact 38 is fixed to the door 42 for closing the chamber 24 (see FIGS. 1 and 3). In the arrangement as constructed, the contacts on the cart contacts 32 and 34 are flexible contacts while the 36 & 38 attached to the end wall and door are plate contacts, but the arrangement as illustrated will operate equally well. The contact 38 is only in operative position when the door 42 is in closed position.

The contacts of the first set of contacts 16, 32 and 34 are all electrically connected to the bottom or secondary electrode 12 of the cart 10.

These flexible contacts are preferably formed from "fingerstock" (as will be described below in conjunction with FIGS. 7, 8 and 9). Generally any gaps in the contacts along the lengths of and between the first set of contacts 16, 32 and 34 and their respective adjacent contacts of the cooperating set of contacts 18, 36, and 38 will not exceed 12 inches (30 cm) and normally will be less than 12 inches (30 cm). The term gaps in contacts is intended to mean longitudinal spacing between adjacent contact areas along any side or end of the cart 10. In other areas where contact is formed the flexible contacts 18, 36 and 38 in the illustrated arrangement will be firmly pressed against their respective solid or plate contacts 16, 32 and 34. As described above the contacts are on all 4 sides of the cart 10 i.e. around the fully perimeter of the cart 10. If a gap is made too long, detrimental effects such as arcing, high circulating currents, field non-uniforrnity, etc. will likely be encountered.

Figure 3A:
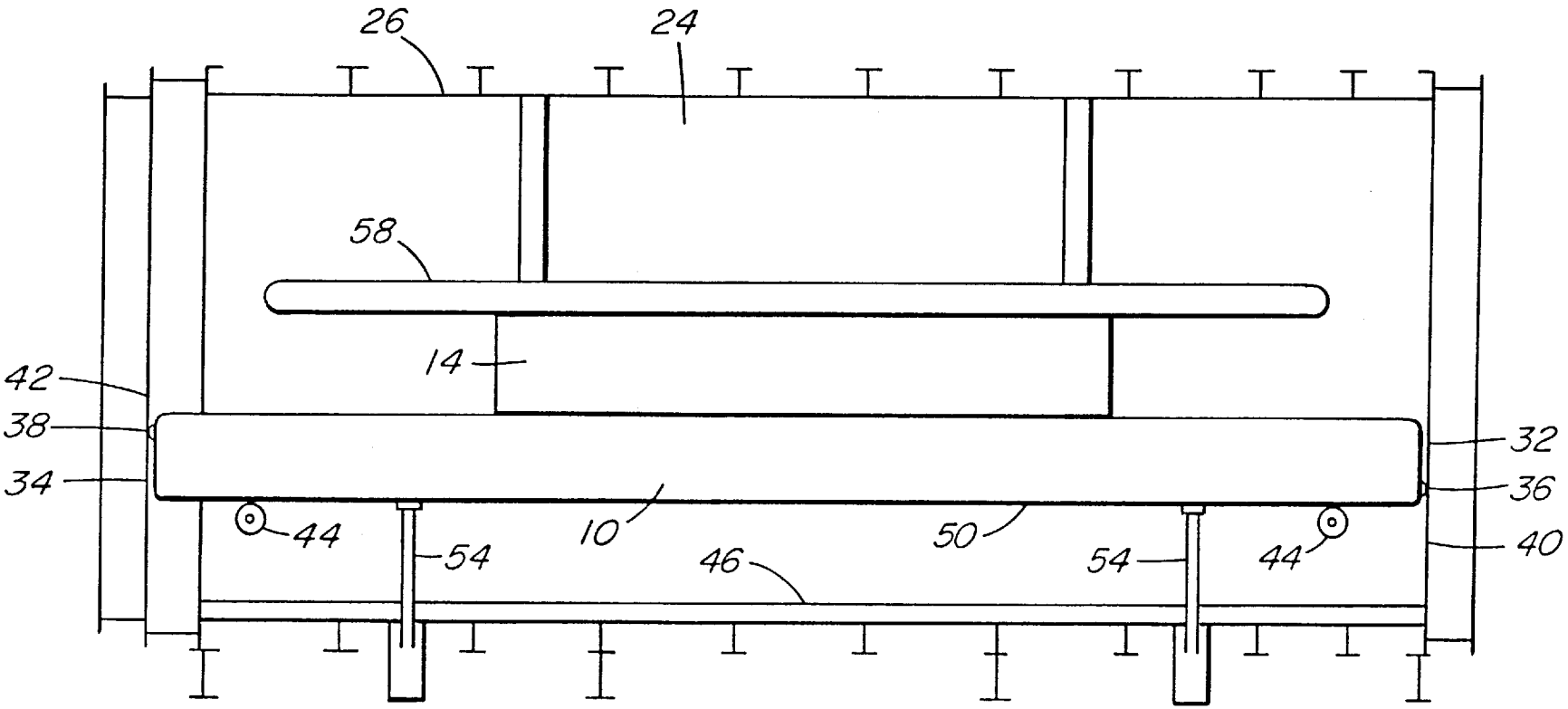
FIG. 3A is a longitudinal section through the kiln showing the cart in heating position in the kiln with the door closed and showing the end contact.

The cart 10 is preferably mounted on wheels 44 which roll along tracks 46 (see FIGS. 2, 3 and 4) when it is moved between the loading position 48 (see FIG. 1) and it operative position 50 (see FIG. 3A).

As above indicated and shown in FIG. 1 and 3, the kiln 26 is provided with a closable door 42 that is moveable from the open position shown in FIG. 1 to a closed position (FIG. 3A) by suitable means as schematically represented by the arrows 68 and 70. In the constructed system, the door is on overhead rollers and is manually opened or closed by horizontally pushing the door. Generally, the door is manually opened/closed but if desired a hydraulic cylinder system represented by arrow 70 may be provided to pull the door 24 toward or push the door away from the kiln 22 to seal the opening into the chamber 24—movement of the door to sealing position as indicated by the arrow 70 compresses a sealing gasket (not shown) extending around the circumference of the opening to seal the kiln and positions the flexible contact 38 in an operative position to contact it plate contact 34 as the cart and load are moved from the operative position 50 into a heating position 56 as will be described below.

Projecting from the floor 52 of the chamber 24 and of the path 22 is a vertical movement system such as plurality of hydraulic pushers 54 illustrated (only 2 shown but there will be a sufficient number strategically positions to lift and hold the cart 10 with the load thereon stabilized in elevated heating position 56 (see FIG. 3A). For some applications, a hydraulic or electrical scissor hoist system (or some other means) may be the preferred vertical movement system.

A primary electrode 58 is suspended from the roof of the kiln 26 on isolators 60 which hold the primary electrode preferably in fixed position in the chamber 24. RF power is delivered to the primary electrode 58 via a connection 62 connected to a suitable source of power 64. For convenience, this connection 62 is shown in FIG. 2 as extending upward at an angle whereas in the actual construction the connection 62 is connected at the center of the electrode 58 and projects out of the chamber at the top. The primary electrode 58 may be fixed since with the present invention the load 14 is moved into contact with the electrode 58 whereas in conventional systems the electrode is lowered onto the surface of the load to make contact The chamber 24 may be placed under vacuum conditions when the door 42 is closed and the chamber 24 is connected to a source of negative pressure (vacuum) as schematically illustrated by the arrow 66. Preferably the vacuum system will be based on the system described in Applicants co-pending US patent application Ser. No. 09/691,148 the teaching of which is incorporated herein by reference. In operation the cart 10 is loaded in loading position 48 and then the cart 10 carrying load 14 is rolled into the chamber 24 into operative position 50 the door 42 of the chamber 24 is closed and hydraulically pulled tight against the chamber door frame to seal the chamber and if vacuum is to be applied, to create a vacuum tight seal. At the same time the door is pushed inward the flexible connecter 38 is positioned in its operative position. The cart is now raised by activating the hydraulic lifting/lowering cylinders until the wood comes into contact with the electrode. As the cart 10 and load 14 are raised by the cylinders 54 into the heating or drying position 56 intimate electrical contact is achieved along each side of the cart 10 between the plate contacts 16, 32 and 34 and their respective flexible contacts 18, 36 and 38 and maintained as the load 14 (wood) is brought into contact with the RF principal electrode 58. The hydraulic system 54 is also used to provide as specified compressive loading on the load 14 throughout the drying process by pushing the cart and its load against the fixed electrode 58.

Figure 5:
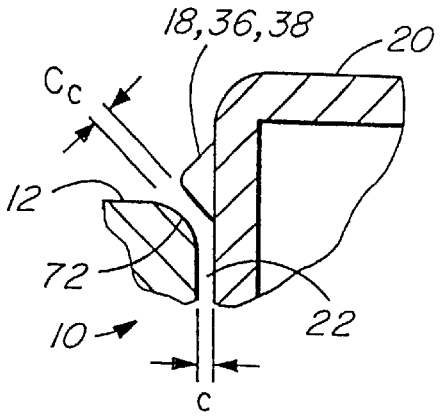
FIG. 5 is a schematic cross section through the kiln showing the relative position of the cart and the flexible contact when the cart is in operative position in the kiln
Figure 6:
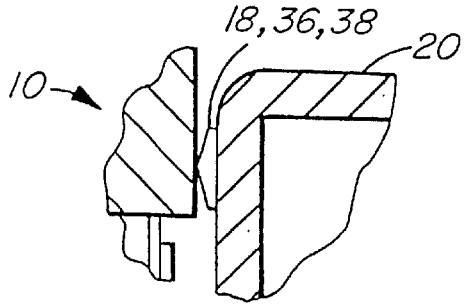
FIG. 6 is a schematic cross sections similar to FIG. 5 but showing the relative position of the cart and the flexible contact when the cart is in elevated heating position in the kiln.

As shown in FIG. 5 when the cart is in the operative position the flexible contacts 18, 36 and 38 are in expanded or rest position and are positioned above the cart 10 particularly the contact plates 16, 32 and 34 of the cart 10 to provide a suitable clearance $C_c$ between the flexible contacts 18, 36 and 38 and the adjacent rounded edge which will have a radius $r_c$. The clearance $C_c$ will generally be at least ½" and the radius $r_c$ will generally be at least 2.25". Obviously a suitable clearance C will be provided between the adjacent side and ends of the cart 10 and path 20 is moved from operative 50 position to the heating position 56.

When the drying or heating process is completed, the power is cut to the system and the vacuum, if applied, is brought back to atmospheric pressure. The carrier 10 and the load 14 lowered to operative position, the door 42 opened and the dried load and carrier 10 are moved to the position 48 which also may function as the unloading position.

Figure 3B:
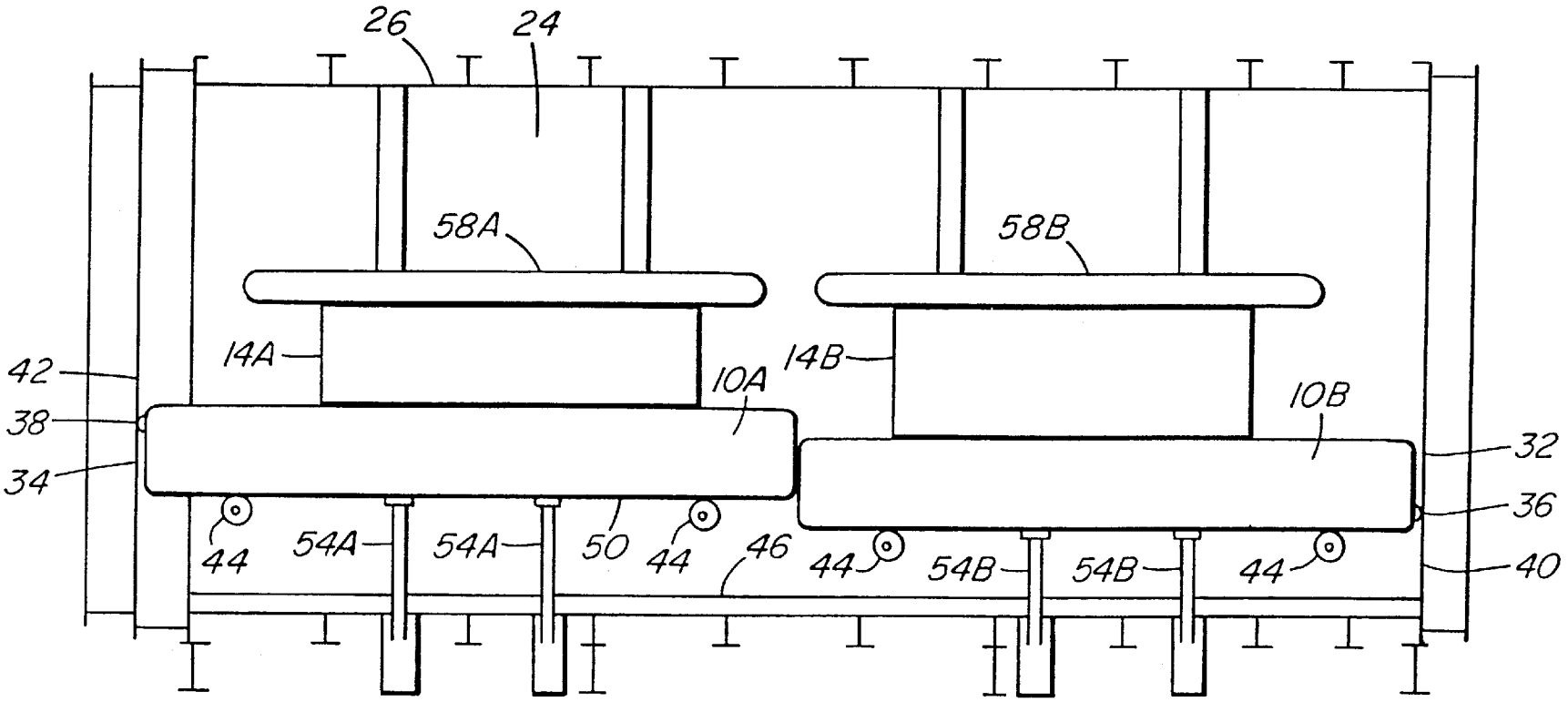
FIG. 3B is a view similar to FIG. 3A but showing a pair of carts in end to end relationship in heating position to heat individual loads positioned one on each of the carts.

It is also possible, as shown in FIG. 3B, for the carrier 10 to take the form of a plurality of individual carts 10A, 10B etc (only 2 carts shown in FIG. 3B) which are positioned in end-to-end relationship along the path 22. In this arrangement, individual electrodes (one for each cart 10A, 10B, etc.) as indicated at 58A, 58B, etc, will be provided and individually supplied with power via connectors (not shown—shown at 62 for the FIG. 1, 2, 3A and 4 embodiment). Electrical connectors are preferably provided to connect adjacent end of adjacent carts 10A, 10B, etc. a mating pair of which are schematically indicated at 100 in FIG. 3B. In some cases it may be desirable to design a system to accommodate individual carts 10A, 10B etc. that contain loads 14A, 14*b* etc. of different heights. In this system, electrical connectors 100 will be designed to accommodate relative movement and each cart 10A, 10B etc. will be provided with and independent lifting system 54A, 54B etc. to elevate each cart.

The construction of the flexible electrical grounding contacts will now be described in more detail. As above indicated, these flexible contacts are preferably made from "fingerstock" as known in the trade which for the present invention preferably consist of thin compressible metal strips of heat treated berilium copper with tin plating. The berilium copper provides a high conductance of electrical current while the tin plating provides corrosion protection. Heat treating of this 'fingerstock' permits the metal strips to maintain its elasticity without permanently deforming and to generate sufficient force to ensure that a positive contact is established and maintained between the contacts forming the mating contacts between the contacts of the first and the cooperating sets of contacts (18, 36 and 38 and their mating contacts 16, 32 and 34).

Figure 7:
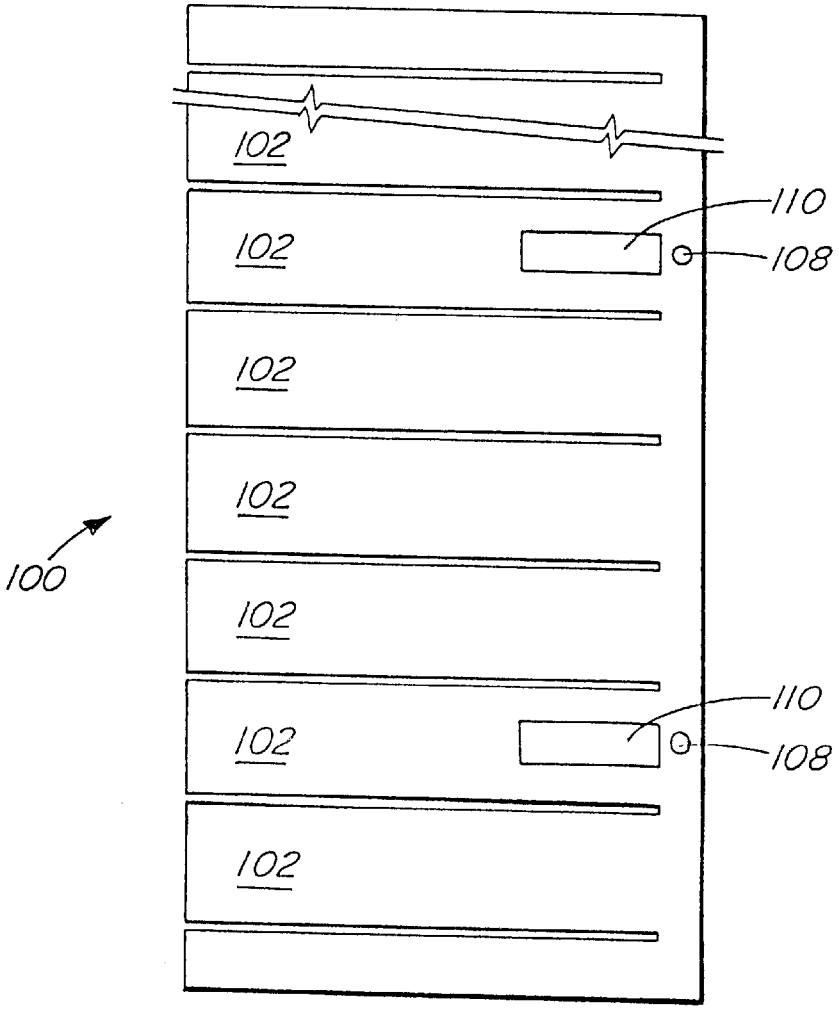
FIG. 7 is a flatted plan view of the fingerstock used to provide the flexible connector.
Figure 8:
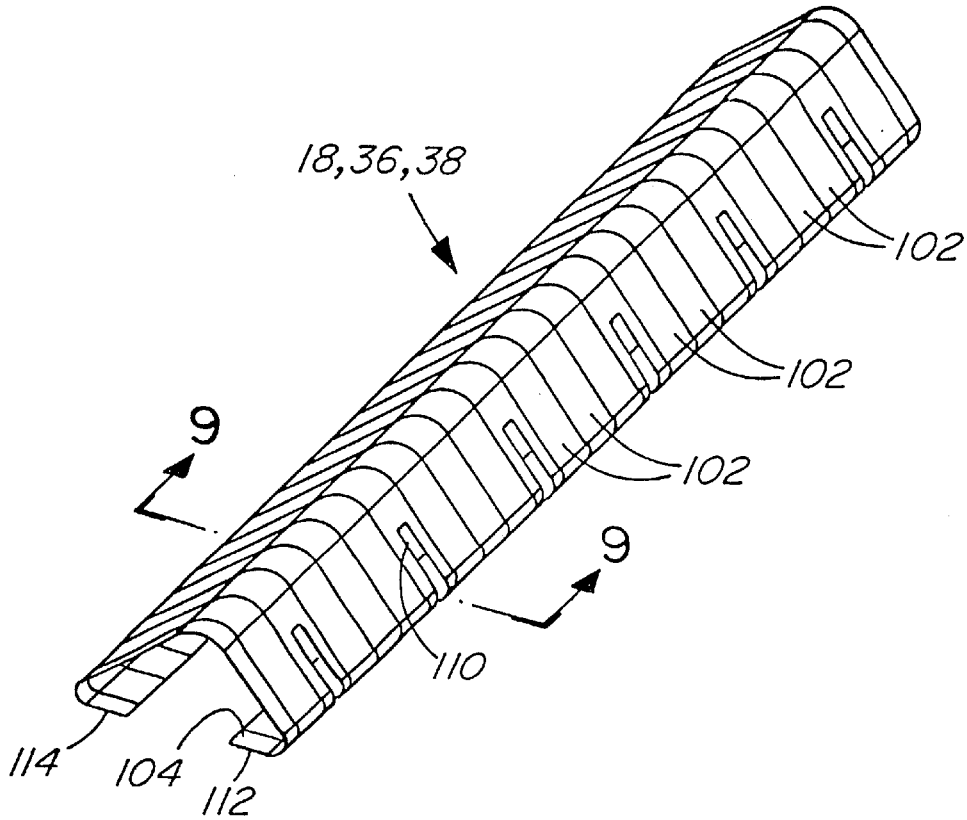
FIG. 8 is an isometric view of the formed fingerstock used to make the flexible connection.
Figure 9:
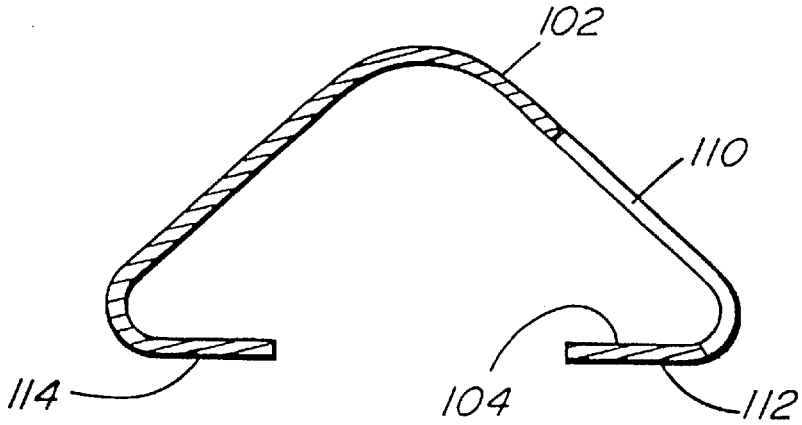
FIG. 9 is a section along the line 9—9 of FIG. 8.

The form of a typical fingerstock strips is illustrated in FIGS. 7, 8 and 9. The strips 100 as shown in flattened condition in FIG. 7 is composed of a plurality of side by side finger elements 102 interconnected at one end by a connecting band 104. Typically the fingers are about 1 ¾ inches (4.5 cm) wide and extend from the band 104 to provide a finger length of about 5 ½ inches (14 cm). The band 104 will normally be about ½ inches wide (1.25 cm) so that the total width of the fingerstock is about 6 inches (15 cm) and the length of the gap measured between the fingers 102 is normally at least about $1/16^{th}$ inches (0.16 cm) but preferably $1/8^{th}$ inches (0.31 cm).

At spaced intervals along the length of the fingerstock 100 suitable mounting holes 108 are provided through which screws or the like may be passed to secure the fingerstock to the sides of the passage or path 22. A section 110 is cut from the finger stock adjacent to each hole 108 to provide access to the screw for mounting.

As shown in FIGS. 8 and 9 the finger stock is formed into a substantially open triangular cross sectional shape with one side of the triangle being incomplete and being formed by one side the connecting band 104 being folded inward and on the other side the free ends of the fingers bend inward as shown in FIG. 9. These bent in portions forming the incomplete side of the open triangle form a pair of bearing surfaces 112 and 114. The bearing surface 112 formed by the band 104 is fixed to the wall of the path 22 and preferable in the illustrated arrangement is located at the bottom of the connectors 18, 36 and 38 while the bearing surfaces 114 formed by the bent over free ends of the fingers 102 forms a sliding contact with the wall of the path 22 to facilitate flexing and compression of the triangular shape when the system (cart 10 and load 12 are in heating position 56 with the contacts being made between the plates 16, 32 and 34 and the flexible contacts 18, 36 and 38 side projecting.

The entire loading process may be computer controlled as indicated by the computer schematically at 200 in FIG. 1 so that a single push button station initiates movement of the cart into the kiln and then following manual closure of the door, automated control is then used for elevation to heating position, application of power and vacuum if desired and at the end of the cycle reversing the operation as described above.

If desired the hydraulic lifters 54 may be provided with load sensors 202 that determine the weight of the load 14 and the change in weight of the load 14 and that are connected to the computer 200 via suitable connects (not shown) to facilitate control of the process. Preferably the load sensors include monitoring the fluid pressure in the hydraulic system lifting and holding the load 14 in heating position. This is of particular benefit in drying lumber. This provides the capability of being able to monitor the cart 10 & load 14 weight by measuring the hydraulic fluid pressure.

An automated system may also be incorporated to weight the load 14 at any time during the drying process. To weight the load 14 the cart 10 and its load 14 must be lowered from the electrode 58 (i.e. remove compressive loading). After weighing the load, the cart and its load are raised back into position against the electrode 58 and the specified compressive loading reapplied. This entire 'weigh load' operation can be completely automated through the Process Control System programmed into the computer 200.

One of the other main advantages of this invention is that there is no manual connecting of grounding connections.

Having described the invention, modifications will be evident to those skilled in the art without departing from the scope of the invention as defined in the appended claims.

We claim:

1. A method for dielectric heating of a load comprising positioning the load on a carrier incorporating a secondary electrode, moving the load on said carrier substantially horizontally into a chamber having a primary electrode positioned above said load when said load on said carrier is moved into an operative position in the chamber, elevating said carrier and said load to vertically move said load into heating position while simultaneously connecting said carrier and thereby said secondary electrode to ground, applying high frequency power to said primary electrode to dielectrically heat said load.

2. A method as defined in claim 1 wherein said high frequency is radio frequency (RF).

3. A method as defined in claim 1 wherein said elevating moves said load into intimate contact with said primary electrode.

4. A method as defined in claim 1 wherein after said heating is completed, said carrier and said load are lowered to said operative position and then said carrier and said load are removed from said chamber.

5. A method as defined in claim 1 further comprising during said heating of said load is separated from said primary electrode and weighed.

6. An apparatus for dielectric heating of a load comprises a carrier, means forming a secondary electrode on said carrier, a first set of electrical contacts along the outer periphery of said carrier and connected to said secondary electrode, a heating chamber, means defining a pathway for said carrier into said chamber, a primary electrode in said chamber positioned above said pathway, elevating means positioned along said pathway so that said carrier when positioned in operative position in said pathway may be lifted by said elevating means into heating position, a cooperating set of electrical contacts secured along said pathway in position to make electrical contact with adjacent contacts of said first set of contacts on said carrier and form mating connections between contacts of said first set of contacts and said cooperating set of contacts when said elevating means has raised said carrier to said heating position from said operative position, and means connecting said primary electrode to a source of high frequency power.

7. An apparatus as defined in claim 6 wherein each of said mating connections is formed by a flexible contact and a plate contact.

8. An apparatus as defined in claim 7 wherein said chamber is provided with at least one door, further electrical contact means on said door, means to move said door to a closed position and to a sealing position wherein said door is sealed and said further electrical contact means are positioned to make electrical contact with an adjacent contact of said first set of electrical contacts when said carrier and load are elevated from said operative position to said heating position.

9. An apparatus as defined in claim 7 wherein said flexible electrical contacts are made from fingerstock that makes pressure contact with said contact plates.

10. An apparatus as defined in claim 9 wherein any longitudinal gaps in contact between contacts of said first set of contacts and their adjacent contacts of said cooperating set of contacts do not exceed 12 inches.

11. An apparatus as defined in claim 9 wherein said fingerstock has fingers extending from a connecting band and formed into an open triangular cross section with a pair of spaced bearing areas forming one incomplete side of said triangular cross section, said connecting band forming one of said pair of bearing areas and free ends of said fingers remote from said connecting band forming the other of said pair of bearing areas.

12. An apparatus as defined in claim 11 wherein said bearing area formed by said band is fixed to its supporting structure and said bearing area formed by said free end bears against but is free to move relative to said supporting structure.

13. An apparatus as defined in claim 11 wherein said carrier is formed by a plurality of carts in end to end relationship and with mating electrical connection being formed between adjacent ends of adjacent of said carts.

14. An apparatus as defined in claim 9 wherein said carrier is formed by a plurality of carts in end to end relationship and with mating electrical connection being formed between adjacent ends of adjacent of said carts.

15. An apparatus as defined in claim 7 wherein said set of cooperating contacts are provided on all sides and end of said pathway and cooperate with adjacent contacts of said first set of contacts at the sides and ends of said carrier.

16. An apparatus as defined in claim 15 wherein said flexible electrical contacts are made from fingerstock.

17. An apparatus as defined in claim 16 wherein any longitudinal gaps in contact between contacts of said first set of contacts and their adjacent contact of said cooperating set of contacts do not exceed 12 inches.

18. An apparatus as defined in claim 16 wherein said fingerstock has fingers extending from a connecting band and formed into an open triangular cross section with a pair of spaced bearing areas forming one incomplete side of said triangular cross section, said connecting band forming one of said pair of bearing areas and free ends of said fingers remote from said connecting band forming the other of said pair of bearing areas.

19. An apparatus as defined in claim 18 wherein said bearing area formed by said band is fixed relative to its supporting structure and said bearing area formed by said free end bears against but is free to move relative to said supporting structure.

20. An apparatus as defined in claim 7 wherein said carrier is formed by a plurality of carts in end to end relationship and with mating electrical connection being formed between adjacent ends of adjacent of said carts.

21. An apparatus as defined in claim 6 wherein said carrier is formed by a plurality of carts in end to end relationship and with mating electrical connection being formed between adjacent ends of adjacent of said carts.

* * * * *